US006957144B2

(12) United States Patent
Arakawa et al.

(10) Patent No.: US 6,957,144 B2
(45) Date of Patent: Oct. 18, 2005

(54) LOCATION CONFIRMATION SYSTEM AND INFORMATION TRANSMITTING METHOD FOR USE IN THE SYSTEM

(75) Inventors: Takeharu Arakawa, Saitama (JP); Yuji Koga, Saitama (JP)

(73) Assignee: Pioneer Corporation, Tokyo (JP)

( * ) Notice: Subject to any disclaimer, the term of this patent is extended or adjusted under 35 U.S.C. 154(b) by 0 days.

(21) Appl. No.: 10/657,102

(22) Filed: Sep. 9, 2003

(65) Prior Publication Data

US 2004/0054464 A1 Mar. 18, 2004

(30) Foreign Application Priority Data

Sep. 13, 2002 (JP) ..... P2002-269169

(51) Int. Cl.[7] ..... G08G 1/13
(52) U.S. Cl. ..... 701/209; 701/207; 342/357.09
(58) Field of Search ..... 701/23, 24, 117, 701/119, 200–213; 342/357.01–357.09, 357.1–357.17

(56) References Cited

U.S. PATENT DOCUMENTS 6,181,683 B1 * 1/2001 Chevillat et al. ..... 370/329
6,587,780 B2 * 7/2003 Trovato ..... 701/117
6,650,252 B2 * 11/2003 Miller, Jr. ..... 340/989
6,650,995 B2 * 11/2003 Bullock ..... 701/117

FOREIGN PATENT DOCUMENTS

DE 196 51 143 A1 6/1998

* cited by examiner

*Primary Examiner*—Richard M. Camby
(74) *Attorney, Agent, or Firm*—Sughrue Mion, PLLC

(57) ABSTRACT

In a location confirmation system, one navigation terminal connects a line to an information center to transmit timing information, and the information center identifies other navigation terminals for exchanging information indicating current locations to transmit the timing information to them. Thereafter, other navigation terminals having received the timing information and one navigation terminal transmit and receive the information indicating each current location at almost equal timing in accordance with the timing information.

10 Claims, 2 Drawing Sheets

LOCATION CONFIRMATION SYSTEM AND INFORMATION TRANSMITTING METHOD FOR USE IN THE SYSTEM

The present disclosure relates to the subject matter contained in Japanese Patent Application No. 2002-269169 filed Sep. 13, 2002, which is incorporated herein by reference in its entirety.

BACKGROUND OF THE INVENTION

1. Field of the Invention

The present invention relates to a navigation terminal mounted on a movable body and a navigation system including the terminal.

2. Description of the Related Art

A car navigation system mounted on a vehicle that is a typical movable body displays a map on a display unit based on a current location of the vehicle determined, with a mark indicating the current location of the vehicle superposed on the map.

In the car navigation system, a positioning unit for determining the current location of the vehicle includes a GPS (Global Positioning System) receiver and various autonomous navigation sensors for calculating the current location from a travel distance and a moving direction of the vehicle. Also, map information for displaying the map on the display unit, relevant information associated with the map information and various kinds of functional services are provided from an information center located outside the vehicle, utilizing a communication unit mounted on the vehicle.

One of the functional services is a location confirmation service. A mobile terminal mounted on each of a plurality of vehicles transmits information indicating the current location to the information center, and the information center stores the received information indicating the current location of each vehicle with identification information for identifying each vehicle. In response to a request signal from a mobile terminal of one vehicle, the information center transmits the information indicating the current locations of other vehicles to the mobile terminal of the one vehicle. In this manner, the mobile terminal of the one vehicle can confirm the current locations of other vehicles.

Since such services require communication, it is necessary to suppress the communication costs taken to confirm the locations of other vehicles.

Also, it is not preferable that the confirmed locations of other vehicles show locations of other vehicles at an older time than the confirmation time.

SUMMARY OF THE INVENTION

The present invention provides a location confirmation system including: a plurality of mobile terminals each having a positioning unit for positioning a current location of a movable body and a communication unit for transmitting and receiving information to and from an information center; and the information center having a center communication unit for transmitting and receiving information to and from the plurality of mobile terminals and a storage unit for storing information received from the plurality of mobile terminals, wherein a timing at which the information is transmitted or received to or from other mobile terminal is decided in accordance with timing information specifying a timing at which the information transmitted from a predetermined mobile terminal is transmitted or received.

DETAILED DESCRIPTION OF THE PREFFERED EMBODIMENTS

Figure 1:
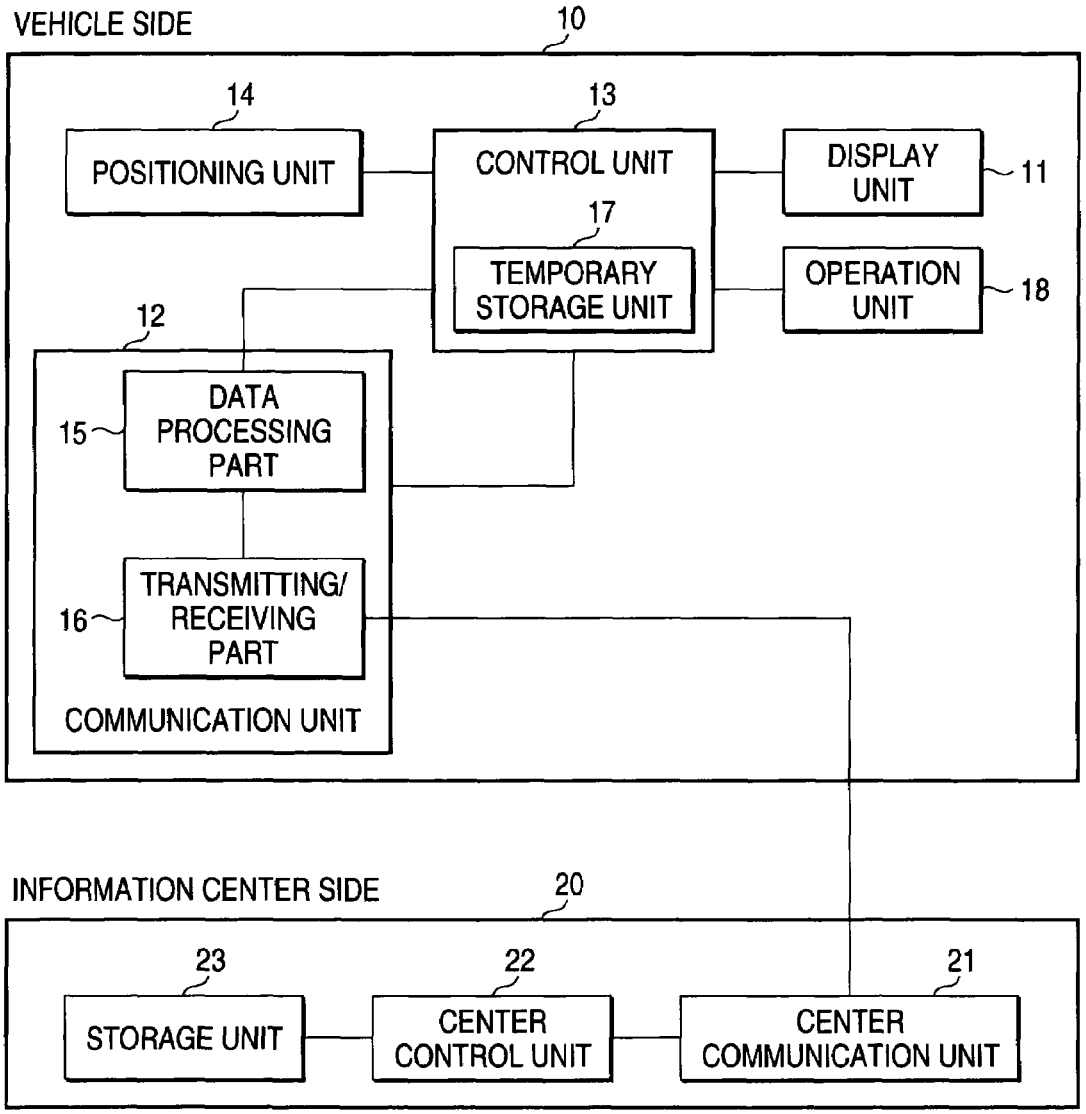
FIG. 1 is a block diagram showing a navigation system according to an embodiment of the present invention.

Referring to FIG. 1, an embodiment of the present invention will be described below. This embodiment employs a location confirmation system of the invention for a navigation system.

In FIG. 1, a numeral 10 denotes a navigation terminal mounted on one vehicle that is a movable body. The navigation terminal 10 includes: a display unit 11; a communication unit 12; a control unit 13 that functions as a display control unit for controlling the display unit 11 and functions as a connection control unit for controlling the timing of transmitting and receiving data for the communication unit 12; a positioning unit 14 for positioning a current location of the vehicle; and an operation unit 18 for enabling a user to input a designation of destination or a route search instruction. Further, the communication unit 12 includes a data processing part 15 for processing the data to be transmitted or received, and a transmitting/receiving part 16 for transmitting and receiving the data.

A numeral 20 denotes the configuration of an information center. The information center 20 includes: a center communication unit 21 for communicating with the communication unit 12 mounted on the vehicle; a storage unit 23 for storing and accumulating in real time various kinds of information. The various kinds of information includes: map information and facility information; traffic information such as congestion information, regulation information and accident information on the road; weather information such as the current weather in each district and weather forecast; and event information held in each district at present or in the future. The information center 20 further includes a center control unit 22 that functions as a center communication unit control part for controlling the center communication unit 21 to make the communication, functions as a reading control part for controlling reading various kinds of information from the storage unit 23, and functions as a calculation part for calculating a drive route of the vehicle.

In the navigation system including the information center 20 and a plurality of vehicles each mounting the navigation terminal 10, various kinds of request commands or information are transmitted from the navigation terminal 10 to the information center 20 via a communication line connecting each communication unit 12 and the center communication unit 21, and various kinds of information are transmitted from the information center 20 to each navigation terminal 10 in response to request commands.

A portable telephone service system and a PHS telephone service system are available for the line connecting the communication unit 12 and the center communication unit 21. Examples of the request command sent from the navigation terminal 10 to the information center 20 may include various kinds of information acquisition commands and functional commands, such as a map request command for acquiring the map information, a location confirmation request command for confirming the locations of other vehicles, a retrieval request command for retrieving a facility or a spot, and an information request command for acquiring various kinds of information including traffic information. These information acquisition commands and functional commands are used in the conventional navigation system.

Herein, the map request command will be detailed below. The control unit 13 outputs a map request information including the current location information and map scale information based on the current location of the vehicle positioned by the positioning unit 14 to the data processing part 15. After various kinds of information is converted into a predetermined format in the data processing part 15, the map request command is transmitted via the transmitting/receiving part 16 to the information center 20.

In the information center 20, the center control unit 22 reads out the map information from the storage unit 23 in response to the map request command acquired via the line connecting the communication unit 12 and the center communication unit 21, and transmits the read map information via the line to the navigation terminal 10.

At the navigation terminal 10, a map is displayed on the display unit 11, based on the map information acquired via the line by the communication unit 12. The control unit 13 includes the temporary storage unit 17 for storing the information, whereby various kinds of information acquired from the information center 20, including the map information, is stored and held, until they are deleted positively upon an instruction of the user.

Subsequently, the location confirmation request command for confirming the locations of other vehicles will be detailed below. This location confirmation request command is transmitted when receiving a location confirmation service. At the navigation terminal 10, a timing desired by the user is decided through an operation of the user and the control of the control unit 13.

This timing is one for transmitting or receiving the information to or from the information center 20. Timing information for defining this timing is converted into a predetermined format in the data processing part 15, and a timing command is transmitted via the transmitting/receiving part 16 to the information center 20.

The timing information transmitted as this timing command includes time definition information for defining the timing and identification information of the self-navigation terminal 10. This time definition information may mean "every hour, five minutes" or "every hour, ten minutes", etc. The "every hour, five minutes" information means every five minutes, namely, five, ten, fifteen minutes, . . . past the hour. Also, the "every hour, ten minutes" information means every ten minutes, namely, ten, twenty, thirty minutes, . . . past the hour.

At this time, the control unit 13 determines whether or not the line connecting the communication unit 12 and the center communication unit 21 is established. When established, the timing command is immediately transmitted from the navigation terminal 10 to the information center 20.

On the other hand, when the control unit 13 determines that the line connecting the communication unit 12 and the center communication unit 21 is not established, first of all, the control unit 13 functions as a connection control unit for controlling the communication unit 12, and starts a connection process for the line connecting the communication unit 12 and the center communication unit 21. Thereafter, when the connection of the line is established, the timing command is transmitted again.

The information center 20 identifies other navigation terminals 10 of which timing is adjusted based on the timing command acquired via the line connecting the communication unit 12 and the center communication unit 21. This identification process is conducted based on the identification information of the navigation terminal 10 included in the timing command, and the identification information and the group information of a plurality of navigation terminals 10 that are stored beforehand in the storage unit 23 of the center control unit 22. That is, in the information center 20, one group information is associated beforehand with a plurality of pieces of identification information, whereby a plurality of navigation terminals 10 are grouped.

Accordingly, the center control unit 20 can identify the navigation terminal 10 and one or more other navigation terminals 10 that are grouped, based on the identification information of the navigation terminal 10 included in the timing command.

The center control unit 20 connects the line with identified one or more other navigation terminals 10, and transmits the timing information to each navigation terminal 10.

In this manner, the timing decided by one navigation terminal 10 is shared with one or more other navigation terminals 10 that are grouped.

Each navigation terminal 10 connects the line to the information center 20, based on this timing, and transmits or receives the information. Through one transmitting or receiving process, each navigation terminal 10 transmits the information indicating the current location of the vehicle at that time to the information center 20, and then the information center 20 transmits the information indicating the current locations of the other vehicles each mounting the navigation terminal 10 which are received at that time to each navigation terminal 10.

In this manner, each navigation terminal 10 mounted on the vehicle is connected via the line to the information center 20 and the information is transmitted or received at the consistent timing, whereby it is possible to prevent the confirmed locations of other vehicles from being confirmed locations of other vehicles acquired at older time than at the confirmed time.

EXAMPLES

Figure 2:
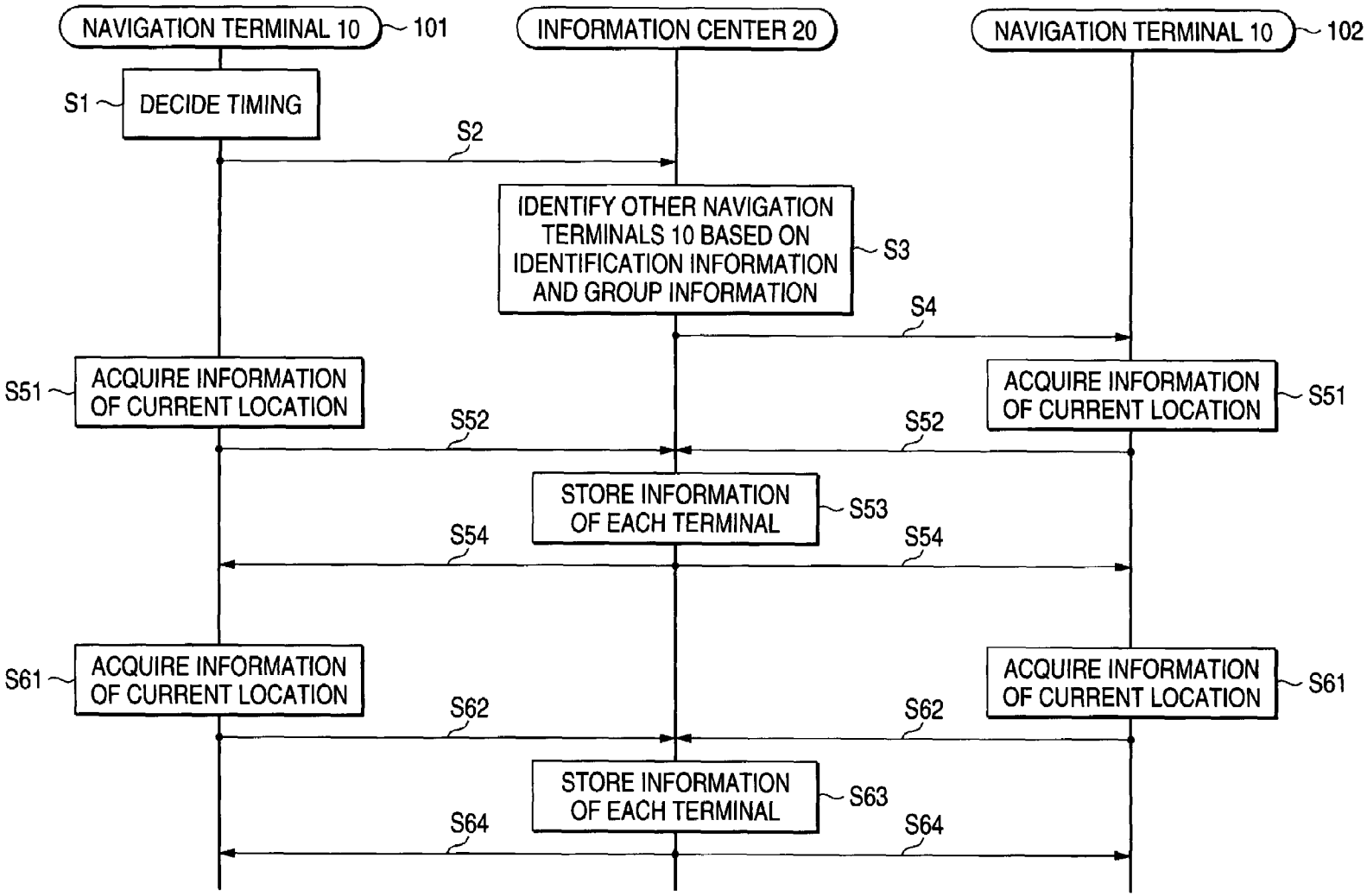
FIG. 2 is a timing chart showing a transmission process according to the embodiment of the invention.

Referring to FIG. 2, one example is detailed below.

FIG. 2 is a timing chart showing a process for transmitting information between the navigation terminals 10 mounted on the vehicles and the information center 20.

In FIG. 2, a numeral 101 denotes the navigation terminal 10 that transmits a timing command, and a numeral 102 denotes the navigation terminal 10 that receives the timing information from the information center 20.

Accordingly, the timing of the navigation terminal 102 is adjusted to the timing defined by the navigation terminal 101 in this example.

First of all, the timing is decided by the navigation terminal 101, whereby a timing command including the time definition information defining the timing and the identification information of the self navigation terminal 10 is transmitted to the information center 20 (step S2).

The information center 20 receiving the timing command identifies one or more other navigation terminals for which the timing is adjusted, based on the identification information of the center control unit 22 and the group information stored beforehand in the storage unit 23 (step S3).

In this example, as other navigation terminals for which the timing is adjusted, one navigation terminal 102 is identified. The invention is not limited to as herein described. A plurality of navigation terminals may be identified to adjust their timing at the same time.

The information center 20 transmits the timing information to the identified navigation terminal 102 (step S4). In the navigation terminal 102 receiving the timing information, the timing for connecting the line to the information center 20 is defined.

In this manner, at the navigation terminals 101 and 102, the timing for connecting the line to the information center 20 is roughly coincident. After that, at the navigation terminals 102 and 102, the following process is performed at the almost equal timing.

First of all, the information indicating the current location at that time is acquired from the positioning unit 14, based on the timing contained in the timing information (step S51). Subsequently, each of the navigation terminals 101 and 102 starts the process for connecting the line to the information center 20 to transmit or receive the information and establish the line connection.

Each of the navigation terminals 101 and 102 then transmits the information indicating the current location of itself via the connected line to the information center 20. At this time, the information indicating the current location and the identification information for identifying the navigation terminal are also transmitted (step S52).

In the information center 20, the received information indicating the current location and the identification information are stored (step S53). Thereby, the information center 20 can acquire the information indicating the current locations of the plurality of navigation terminals 10 at a predetermined timing (time).

Subsequently, the information center 20 transmits the information indicating the current location of another vehicle to each of the navigation terminals 101 and 102 (step S54). That is, the information indicating the current location of the navigation terminal 102 received at step S52 is transmitted to the navigation terminal 101, while the information indicating the current location of the navigation terminal 101 received at step S52 is transmitted to the navigation terminal 102.

In this manner, the navigation terminals 101 and 102 transmit or receive the information indicating the current location at the almost equal timing.

After that, the same process is repeated at every timing defined by the timing information (steps S61 to S64).

In the above example, the information center identifies the navigation terminals to exchange the information indicating the current location, employing the group information. Besides, the user of the navigation terminal for transmitting the timing command may designate the specific navigation terminal. In this case, the identification information of the navigation terminal to be designated that is included in the timing command may be transmitted.

Also, in the example, the timing information transmitted as the timing command is in a format of "every hour, five minutes". Besides, a time information indicating an interval may be provided such as "every five minutes" or "every ten minutes". In this format, it is required to decide the start time as a reference of clocking the interval. The user may define this start time in transmitting the timing command. Also, as another preferable method, when the information center 20 completes the operation for identifying the navigation terminals 10 to exchange the information indicating the current location based on the group information, the control unit 22 of the information center 20 may automatically decide the start time. In this case, the start time information indicating the start time decided by the control unit 22 and the timing information are transmitted to each navigation terminal 10.

In the example, the navigation terminals 10 mounted on the vehicles exchange the information indicating the current location via the information center 20. In the location confirmation system of this invention, the portable telephone terminals may exchange the information indicating the current location via the information center 20, or the navigation terminal mounted on the vehicle and the portable telephone terminal may exchange the information indicating the current location via the information center 20, whereby the invention is applicable to the case in which movable bodies exchange the information.

Also, all the terminals are not necessarily mobile terminals, One terminal may be unmovable such as a computer installed within the house. In this case, a monitoring system for confirming the locations of plural movable bodies can be configured by the computer.

In the embodiment and the example as described above, the information indicating the current locations of other movable bodies acquired by a certain movable body is utilized in the following ways. For example, a mark indicating the location of one or more other movable bodies is displayed on the map displayed on the display unit of the movable body (display unit 11 of the navigation terminal 10) to confirm the locations of other movable bodies. Also, the distance between movable bodies may be calculated from the information indicating the current location of each movable body, and may be displayed on the display unit of each terminal.

In the embodiment and the example as described above, a computer program may be configured to enable a computer to perform the same functions.

What is claimed is:

1. A location confirmation system comprising:

a plurality of mobile terminals each having a positioning unit for positioning a current location of a movable body and a communication unit for transmitting and receiving information to and from an information center; and the information center having a center communication unit for transmitting and receiving information to and from the plurality of mobile terminals and a storage unit for storing information received from the plurality of mobile terminals, wherein a timing at which the information is transmitted or received between the information center and a mobile terminal is decided in accordance with timing information which has been transmitted from another mobile terminal to the information center and which specifies a timing at which the information is transmitted or received.

2. The location confirmation system according to claim 1, wherein the timing information includes identification information for identifying the another mobile terminal and definition information for defining the timing.

3. A computer program product for causing a computer to serve as a location confirmation system, the program product comprising:

means for positioning a current location of a movable body;

means for transmitting/receiving information to and from an information center;

means for transmitting/receiving information to and from a plurality of mobile terminals;

means for storing information received from the plurality of mobile terminals, wherein a timing at which the information is transmitted or received between the information center and at least some of said plurality of mobile terminals is decided in accordance with timing information which has been transmitted from one mobile terminal to the information center and which specifies a timing at which the information is transmitted or received.

4. An information transmitting method for use in a location confirmation system including a plurality of mobile terminals each having a positioning unit for positioning a current location of a movable body and a communication unit for transmitting and receiving information to and from an information center, and the information center having a center communication unit for transmitting and receiving information to and from the plurality of mobile terminals and a storage unit for storing information received from the plurality of mobile terminals, the information transmitting method comprising:

deciding a timing at which the information is transmitted or received between the information center and a mobile terminal in accordance with timing information which has been transmitted from another mobile terminal to the information center and which specifies a timing at which the information is transmitted or received.

5. A location confirmation system comprising:

a plurality of mobile terminals each having a positioning unit for positioning a current location of a movable body and a communication unit for transmitting and receiving information to and from an information center; and the information center having a center communication unit for transmitting and receiving information to and from the plurality of mobile terminals and a storage unit for storing information received from the plurality of mobile terminals, wherein the information is transmitted or received between the information center and at least some of said plurality of mobile terminals substantially at the same time in accordance with timing information which has been transmitted from one mobile terminal to the information center and which specifies a timing at which the information is transmitted or received.

6. A mobile terminal comprising:

a positioning unit for locating a current position of the mobile terminal;

a communication unit for transmitting and receiving information to and from an information center;

a display unit; and a control unit for controlling the communication unit and the display unit, wherein the control unit controls the communication unit to transmit a timing command that specifies a timing to an information center, the control unit controls the communication unit to receive information on a position of a mobile terminal from the information center which has been acquired by communicating with another mobile terminal at the timing in accordance with the timing command, and the control unit controls the display unit to display the information on the position of the another terminal.

7. The mobile terminal according to claim 6, wherein the control unit controls the display unit to display a mark that indicates the location of the another terminal relative to the mobile terminal.

8. The mobile terminal according to claim 6, wherein the information center transmits timing information at the timing in accordance with the timing command, the timing information making said another mobile terminal to transmit the information on the location of said another mobile terminal to the information center, and the information center acquires the information on the location of said another mobile terminal transmitted from said another mobile terminal in accordance with the timing information.

9. An information center comprising:

a communication unit for transmitting and receiving information to and from a plurality of mobile terminals; and a control unit for controlling the communication unit, wherein upon reception of a timing command transmitted from one terminal, the control unit controls the communication unit to transmit timing information to another terminal at a timing in accordance with the timing command, the timing information making the other terminal to transmit the location information to the information center, and upon reception of the location information, transmitted in accordance with the timing information, the control unit controls the communication unit to transmit the location information of said another mobile terminal to the one terminal.

10. The information center according to claim 9, wherein the one terminal transmits information on a location of the one terminal to the information center at the timing in accordance with the timing command, and upon reception of the information on the location of the one terminal, the control unit controls the communication unit to transmit the information on the location of the one terminal thus received to said another terminal.

* * * * *